US007131722B2

(12) United States Patent
Yoneyama et al.

(10) Patent No.: US 7,131,722 B2
(45) Date of Patent: Nov. 7, 2006

(54) INK JET PRINTER AND IMAGE RECORDING METHOD USING A HUMIDITY DETECTOR TO CONTROL THE CURING OF AN IMAGE

(75) Inventors: Tsutomu Yoneyama, Hachioji (JP); Yoshiyuki Suzuki, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/647,367

(22) Filed: Aug. 25, 2003

(65) Prior Publication Data

US 2004/0041892 A1 Mar. 4, 2004

(30) Foreign Application Priority Data

Aug. 30, 2002 (JP) ..... 2002-256151
Aug. 30, 2002 (JP) ..... 2002-256154

(51) Int. Cl.
*B41J 2/01* (2006.01)

(52) U.S. Cl. ..... 347/102; 347/101

(58) Field of Classification Search ..... 347/102, 347/101, 100, 95, 96; 399/335, 336, 1; 101/424.01, 101/1; 34/275, 528, 529, 1; 219/216; 106/31.27, 106/31.13; 400/1

See application file for complete search history.

(56) References Cited

U.S. PATENT DOCUMENTS 4,033,263 A * 7/1977 Richmond ..... 101/424.1
6,179,418 B1 * 1/2001 Mizoguchi et al. ..... 347/102
6,232,361 B1 * 5/2001 Laksin et al. ..... 522/84
6,280,801 B1 * 8/2001 Schmitt ..... 427/511
6,350,071 B1 * 2/2002 Conwell et al. ..... 400/118.2
6,523,948 B1 * 2/2003 Matsumoto et al. ..... 347/102

* cited by examiner

*Primary Examiner*—Manish S. Shah
(74) *Attorney, Agent, or Firm*—Cohen, Pontani, Lieberman & Pavane

(57) ABSTRACT

An ink jet printer is configured to enhance curability of cationic polymerization ink and to minimize a damaging thermal effect on a recording medium. The ink jet printer for recording a desired image on a recording medium by ejecting ink which includes a cationic polymerization component and which is curable when irradiated with UV light, has: a recording head for ejecting the ink to the recording medium; a UV light irradiation section for irradiating the UV light to the ink placed on the recording medium; a humidity detecting section for detecting humidity around the ink placed on the recording medium; and a controller for controlling UV irradiation of the light to be irradiated from the UV light irradiation section on the basis of the detected humidity.

10 Claims, 12 Drawing Sheets

INK JET PRINTER AND IMAGE RECORDING METHOD USING A HUMIDITY DETECTOR TO CONTROL THE CURING OF AN IMAGE

BACKGROUND OF THE INVENTION

1. Field of the Invention

The present invention relates to an ink jet printer and an image recording method.

2. Description of Related Art

An ink jet printer for ejecting ink to a recording medium and recording a desired image on a recording surface of the recording medium has been known well. When so-called cationic polymerization ink, having a cationic polymerization component, is irradiated with UV radiation after it has been ejected by the ink jet printer as a drop on a recording medium at a predetermined position, the ink is cured or polymerized. As a result of polymerization, a dot is formed on the recording medium.

The above-described cationic polymerization ink has humidity dependence. Therefore, the ink may not be cured sufficiently because its sensitivity to UV radiation in a humid environment is lowered. However, when temperature of the ink is raised higher than predetermined temperature (for example, about 40 ° C.), it is possible to prevent the sensitivity of the cationic polymerization ink to UV radiation from being lowered. As a result, to increase the sensitivity of the ink to UV radiation under relatively high humidity, the recording medium is treated at elevated temperatures so as to polymerize ink placed on the recording medium.

When the recording medium is a paper, or the like which is hardly affected by the temperature, elevated temperatures do not cause any significant problems. However, when the recording medium is made of resin or the like, it is affected by the elevated temperatures. Therefore, because the recording medium shrinks or is distorted when heated, heating the recording medium causes image quality to degrade since the recording medium is not precisely conveyed.

Further, it is possible to effectively cure the cationic polymerization ink by irradiating UV radiation of high luminance to the ink. However, because the amount of heat generated from a light source of UV radiation may become large, the temperature of the recording medium is raised. As a result, the same result as the above-described one is caused.

SUMMARY OF THE INVENTION

An object of the present invention is to enhance curability of cationic polymerization ink while minimizing heating of a recording medium onto which the ink is applied.

In accordance with a first aspect of the present invention, an ink jet printer for recording a desired image on a recording medium by ejecting ink which includes a cationic polymerization component and which is curable when irradiated with light to the recording medium, comprises: a recording head for ejecting the ink to the recording medium; a light irradiation section for irradiating the light to the ink placed on the recording medium; a humidity detecting section for detecting humidity around the ink placed on the recording medium; and a controller for controlling irradiation of the light to be irradiated from the light irradiation section on the basis of detected humidity detected by the humidity detecting section.

According to the printer of the first aspect of the present invention, when the humidity detecting section detects humidity around ink placed on the recording medium, the controller controls irradiation of light to be irradiated from the light irradiation section on the basis of the detected humidity detected by the humidity detecting section. That is, in case the humidity around the ink placed on the recording medium is high, it is possible to control the irradiation of the light so as to be higher. Further, in case the humidity is low, it is possible to control the irradiation of the light so as to be lower.

Consequently, only when the humidity around the ink placed on the recording medium is high, the luminance of the light to be irradiated from the light irradiation section is increased. On the other hand, when the humidity is low, the luminance of the light to be irradiated from the light irradiation section may even be lowered. Accordingly, more than necessary light is not irradiated to the recording medium. As a result, it is possible to enhance curability of so-called cationic polymerization ink including a cationic polymerization component while minimizing and even preventing a rise in temperature of the recording medium irradiated with light.

Preferably, in the printer of the first aspect of the present invention, the controller controls the irradiation of the light to be irradiated from the light irradiation section on the basis of a relationship between the detected humidity detected by the humidity detecting section, and desired irradiation and desired irradiation time of the light corresponding to the detected humidity.

Preferably, in the printer of the first aspect of the present invention or as described above, the controller has a conversion table showing a relationship between the detected humidity detected by the humidity detecting section, and desired irradiation and desired irradiation time of the light corresponding to the detected humidity.

More preferably, the controller comprises a central processing unit, and performs processing for calculating the desired irradiation and the desired irradiation time corresponding to the detected humidity by using the conversion table with the central processing unit.

More preferably, the controller determines whether the desired irradiation calculated is not lower than maximum limited irradiation or not by performing the processing for calculating the desired irradiation and the desired irradiation time corresponding to the detected humidity by using the conversion table.

More preferably, the light irradiation section irradiates the light of the desired irradiation for the desired irradiation time.

More preferably, the maximum limited irradiation is any lower irradiation of irradiation determined on the basis of electricity consumption of the light irradiation section and irradiation determined on the basis of life span of the light irradiation section within irradiation of UV radiation capable of being irradiated to the recording medium without shrinking and distorting the recording medium.

More preferably, the conversion table is determined on the basis of sensitivity of the ink to the light.

More preferably, the controller changes the conversion table according to a type of the ink.

More preferably, the controller determines a plurality of maximum limited irradiation on the basis of a type of the recording medium.

More preferably, the controller selects any one maximum limited irradiation among the plurality of maximum limited irradiation on the basis of the type of the recording medium.

More preferably, the central processing unit of the controller informs of abnormality of at least one of humidity environment and a light irradiation condition when determining that the desired irradiation calculated based on the detected humidity is not lower than the maximum limited irradiation.

More preferably, the printer further comprises a display section for displaying a screen for informing of the abnormality of at least one of humidity environment and the light irradiation condition according to an instruction of the central processing unit.

More preferably, the central processing unit of the controller raises irradiation of the light to be irradiated from the light irradiation section to the desired irradiation, and determines the desired irradiation time when determining that the desired irradiation calculated based on the detected humidity is lower than the maximum limited irradiation.

Preferably, in the printer of the first aspect of the present invention, the light irradiation section irradiates UV radiation as the light.

More preferably, the light irradiation section irradiates the light having irradiation that maximum irradiation of an effective wavelength range in curing the ink is 0.1 to 50 $mW/cm^2$ or 51 to 3000 $mW/cm^2$.

Preferably, in the printer of the first aspect of the present invention, the light irradiation section takes two steps to irradiate the light.

More preferably, the light irradiation section carries a first light irradiation after the ink is placed on the recording medium and carries a second light irradiation after the first light irradiation.

More preferably, the first light irradiation is carried in 0.001 to 2.0 seconds after the ink is placed on the recording medium, more preferably 0.001 to 1.0 second.

Preferably, in the printer of the first aspect of the present invention, the humidity detecting section is provided in a distance capable of detecting the humidity around the ink from the recording head in a carrying direction of the recording medium above the recording medium.

Preferably, the printer of the first aspect of the present invention further comprises a plurality of humidity detecting sections for detecting humidity around the ink placed on the recording medium.

Preferably, the printer of the first aspect of the present invention further comprises: a carrying section for carrying the recording medium in a predetermined carrying direction; and a dehumidifying section for dehumidifying a portion around the ink placed on the recording medium by sending dry air to the portion around the ink placed on the recording medium.

Because the printer comprises the dehumidifying section, it is possible to keep the portion around ink placed on the recording medium in a dehumidified low-humidity environment and to cure the ink without lowering sensitivity to UV radiation. In the case, because it is unnecessary that the light irradiation section irradiates light having high irradiation more than necessary in order to enhance curability of the ink, it is possible to control the amount of heat generated by the light irradiation section and to prevent the raise in temperature of the recording medium. As a result, it is possible to enhance curability of so-called cationic polymerization ink including a cationic polymerization component, with preventing the raise in temperature of the recording medium as possible.

Preferably, the controller determines whether the detected humidity detected by the humidity detecting section is not lower than predetermined humidity on the basis of the detected humidity, and makes the dehumidifying section operate when determining that the detected humidity is not lower than the predetermined humidity.

Accordingly, because the dehumidifying section is controlled so as to operate when the humidity detected by the humidity detecting section is not lower than the predetermined humidity, it is possible to substantially keep the portion around ink placed on the recording medium in humidity environment having humidity lower than the predetermined humidity. Further, in the case, when the humidity detected by the humidity detecting section is lower than the predetermined humidity, it is possible to provide a period that the dehumidifying section does not operate. As a result, because the period that the dehumidifying section does not operate is provide, it is possible to reduce electricity consumption required to drive the dehumidifying section for the period.

Preferably, the dehumidifying section sends the dry air in substantially all width of the recording medium.

Accordingly, because the dry air is sent in substantially all width of the recording medium, it is possible to equally dehumidify the portion around ink placed on the recording medium in substantially all width of the recording medium.

Preferably, the dehumidifying section comprises an electronic cooling device, and sends the dry air cooled by the electronic cooling device.

Accordingly, because the dry air cooled by the dehumidifying section is sent to the recording medium as a cold wind, the recording medium is cooled down by the dehumidifying section. As a result, it is possible to prevent the raise in temperature of the recording medium irradiated with light emitted from the light irradiation section.

Preferably, the dehumidifying section is provided in a distance capable of dehumidifying the portion around the ink from the light irradiation section in the predetermined carrying direction of the recording medium.

Accordingly, because the dehumidifying section is provided in the distance capable of dehumidifying the portion around the ink from the light irradiation section in the predetermined carrying direction of the recording medium, the recording medium receives the dry air cooled by the dehumidifying section just after irradiated with light emitted from the light irradiation section. That is, even when the raise in temperature of the recording medium is caused by irradiating light to the recording medium, the recording medium is cooled with the cooled dry air. As a result, it is possible to certainly prevent the raise in temperature of the recording medium irradiated with light emitted from the light irradiation section.

In accordance with a second aspect of the present invention, an image recording method for recording a desired image on a recording medium by ejecting ink which includes a cationic polymerization component and which is curable when irradiated with light to the recording medium, comprises: ejecting the ink to the recording medium; irradiating the light to the ink placed on the recording medium; detecting humidity around the ink placed on the recording medium; and controlling irradiation of the light to be irradiated on the basis of the humidity detected.

Preferably, the method of the second aspect of the present invention, further comprises: carrying the recording medium in a predetermined carrying direction; and dehumidifying a portion around the ink placed on the recording medium by sending dry air to the portion around the ink placed on the recording medium.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, an embodiment of an ink jet printer of the present invention will be explained with reference to figures. The ink jet printer will be called a printer. The definition of present invention is not limited to the figures.

Figure 1:
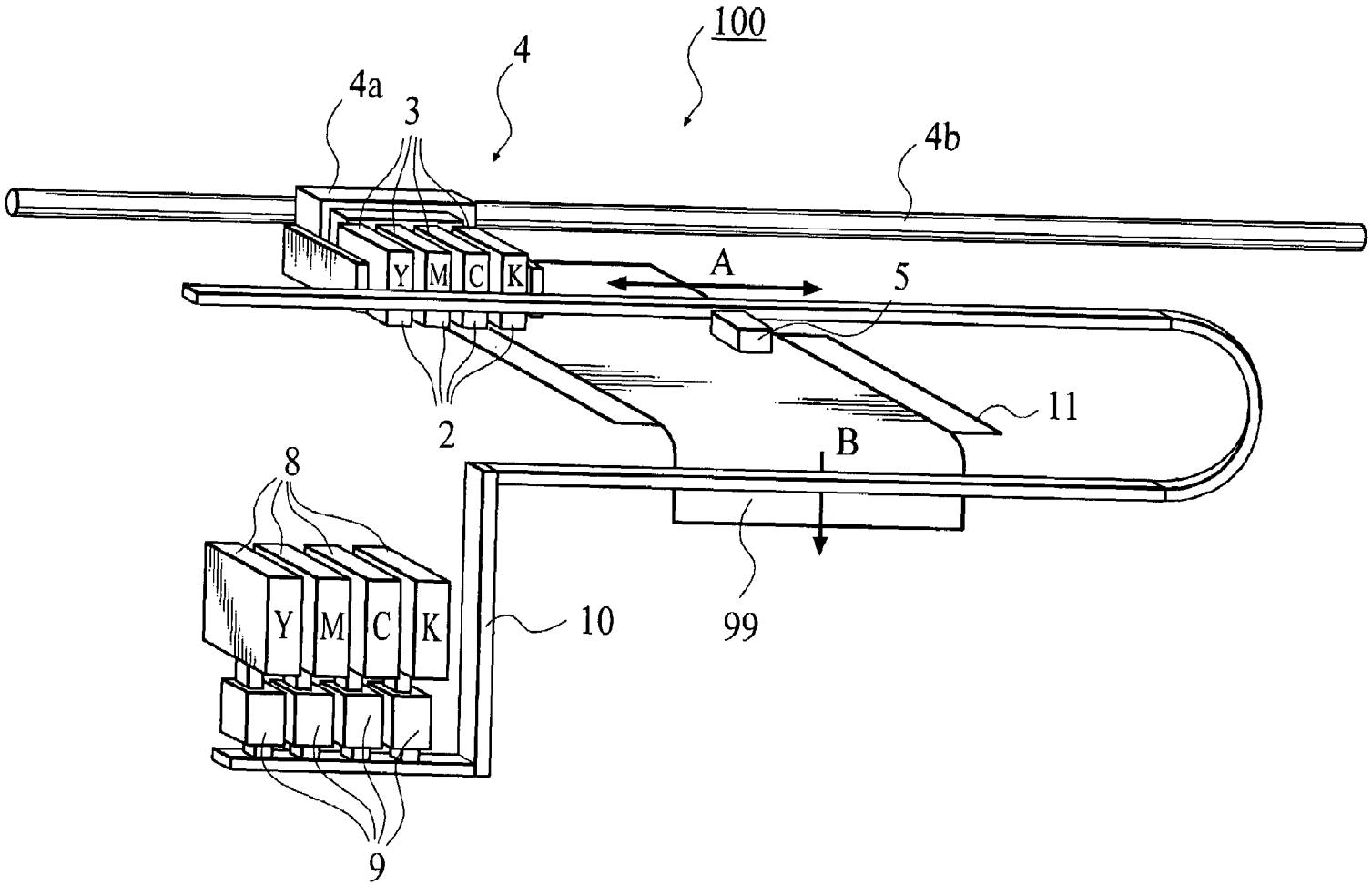
FIG. 1 is a perspective view showing a schematic structure of an ink jet printer 100 according to a first embodiment of the present invention.

FIG. 1 is a perspective view showing a schematic structure of a printer 1 according to the first embodiment.

Figure 4:
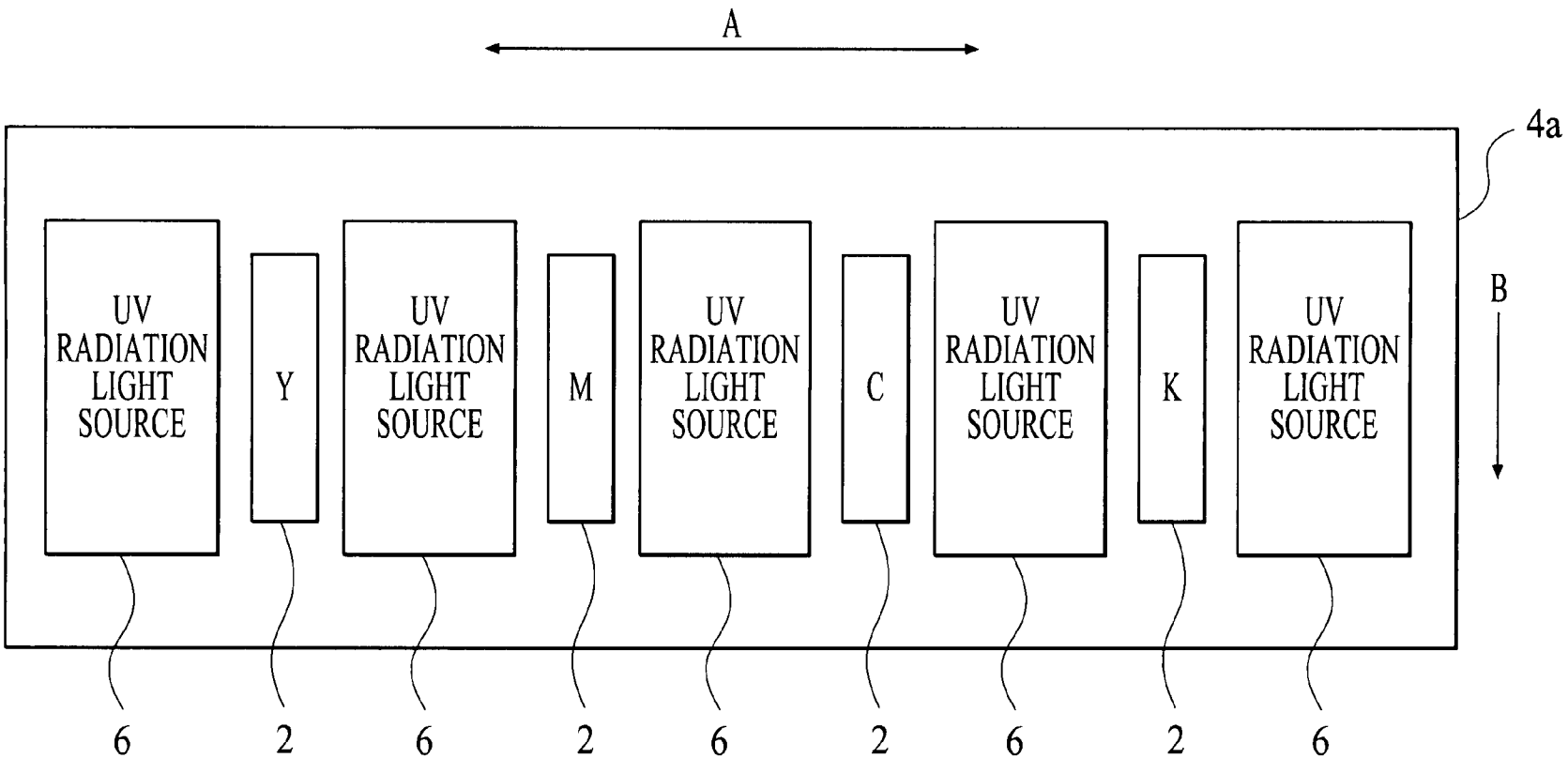
FIG. 4 is a plan view showing arrangement of recording heads 2 and UV radiation light sources 6 at a carriage 4 of the ink jet printer 100.
Figure 5:
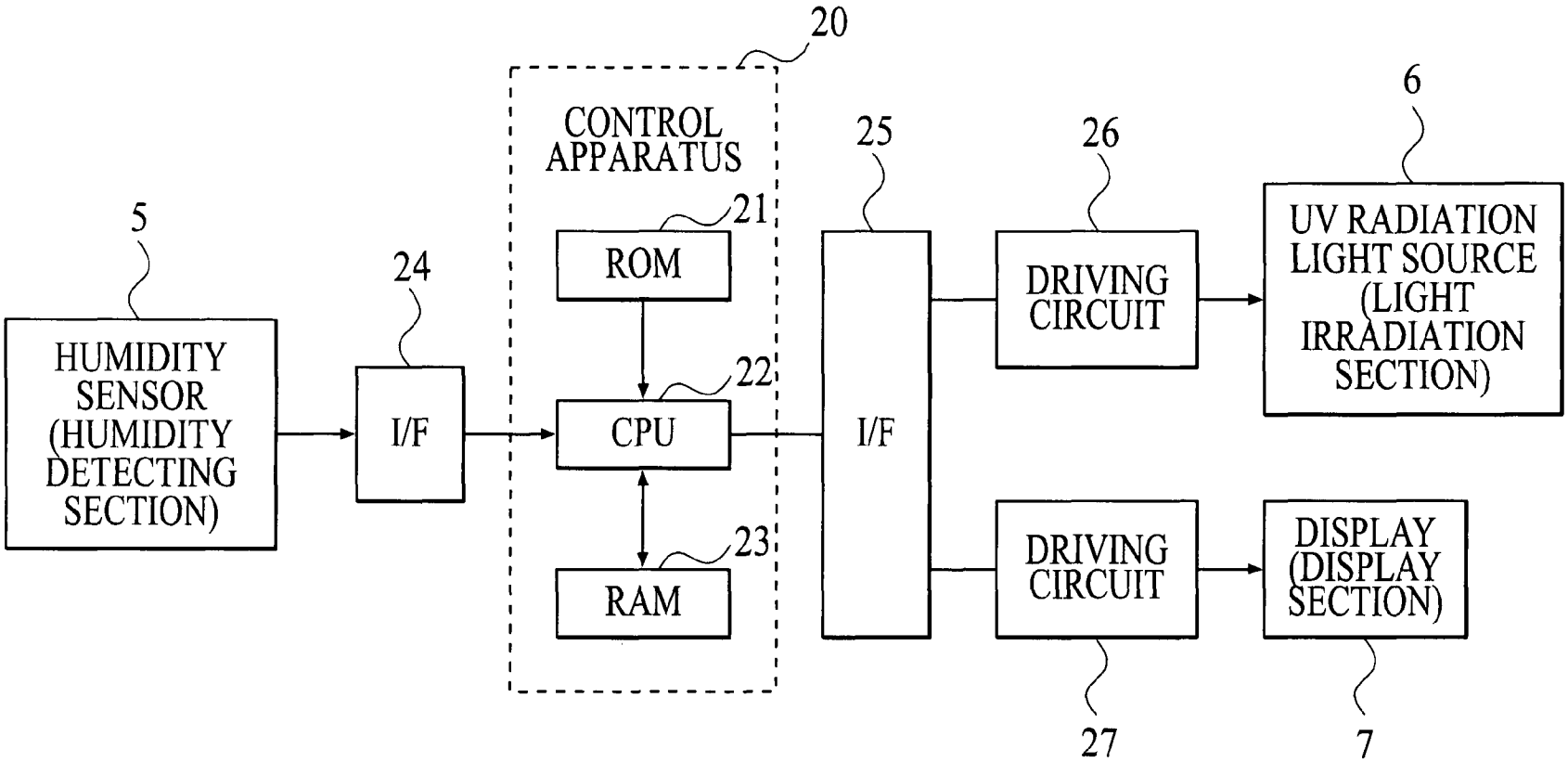
FIG. 5 is a block diagram showing a circuit structure of the ink jet printer 100.

As shown in FIG. 1, the printer 1 comprises, as main components, four recording heads 2, 2, 2 and 2 for ejecting ink to a recording surface of a recording medium 99, four sub tanks 3, 3, 3, and 3 for supplying ink to the recording heads 2 respectively, a carriage section 4 comprising a carriage 4*a* movable in a main scanning direction A, a humidity sensor 5 for detecting humidity around ink ejected from each recording head 2 and placed on the recording medium 99, a plurality of UV radiation light sources 6, 6 and so on which is shown in FIG. 4, for irradiating UV radiation to the ink placed on the recording medium 99, a display 7 which is shown in FIG. 5, for displaying various screens thereon, four main tanks 8, 8, 8 and 8 for storing four colures of ink, four pressure pumps 9, 9, 9 and 9 connected to the main tanks 8 respectively, an ink supply member 10 for supplying ink from each main tank 8 to each sub tank 3, a platen 11 for vacuuming and holding a non-recording surface of the recording medium 99, a carrying section which is not shown in figures for carrying the recording medium 99 in a sub scanning direction B, and a controller 20 which is shown in FIG. 5 for controlling irradiation of UV radiation emitted from the UV radiation light sources 6.

The printer 100 comprises the above-described sections. Therefore, the printer 100 ejects ink as a drop from each recording head 2 to the recording medium 99 and records a desired image on the recording surface of the recording medium 99.

The carrying section comprises a carrying motor, a carrying roller or the like which is not shown in figures, and has a function for carrying the recording medium 99 in the sub scanning direction B by driving the carrying motor. More specifically, the carrying section carries the recording medium 99 intermittently in time with movement of the carriage 4*a*. That is, the carrying station repeatedly alternates carrying and stopping of the recording medium 99. The sub scanning direction B agrees with the carrying direction of the recording medium 99.

The platen 11 vacuums and holds the non-recording surface of the recording medium 99 carried in the sub scanning direction B. More specifically, a vacuum room comprising a fan is provided at a lower portion of the platen 11, and a vacuum opening comprising a plurality of small holes connecting to the vacuum room is formed at the platen 11. Therefore, the platen 11 can vacuum the non-recording surface of the recording medium 99 on the platen 11 by driving the fan of the vacuum room. Accordingly, it is possible to carry the recording medium 99 in the sub scanning direction B in the state the recording medium 99 is contacted with the platen 11 by driving both the fan and the carrying section.

The main tanks 8 are, for example, changeable ink cartridges. The main tanks 8 store process colors based on yellow (Y), magenta (M), cyan (C) and black (K) respectively.

The ink supply member 10 is member connecting from four main tanks 8, 8, 8 and 8 to four sub tanks 3, 3, 3, and 3 respectively, for supplying ink from the main tanks 8 to the sub tanks 3 connected to the main tanks 8 respectively. The ink supply member 10 consists of a flexible member so as to follow movement of the carriage 4*a* as follows.

Four pressure pumps 9, 9, 9 and 9 stands between the ink supply member 10 and four main tanks 8, 8, 8 and 8 respectively. The pressure pumps 9 are provided for the main tanks 8 respectively. The pressure pumps 9 make the supply of ink from the main tanks 8 possible. That is, ink is supplied from the main tanks 8 to the sub tanks 3 connected to the main tanks 8 by the pressure pumps 9, respectively.

Four sub tanks 3, 3, 3, and 3 stores ink stored in four main tanks 8, 8, 8 and 8 respectively, temporarily. That is, ink is supplied to the sub tanks 3 from the main tanks 8 connected to the sub tanks 3 respectively, through the ink supply member 10. Further, one recording head 2 is connected to each sub tank 3, and the sub tanks 3 have functions for supplying ink which is temporarily stored therein to the recording heads 2 respectively. Further, the sub tanks 3 are mounted on the carriage 4*a*, and can follow movement of the carriage 4*a*.

Figure 2A:
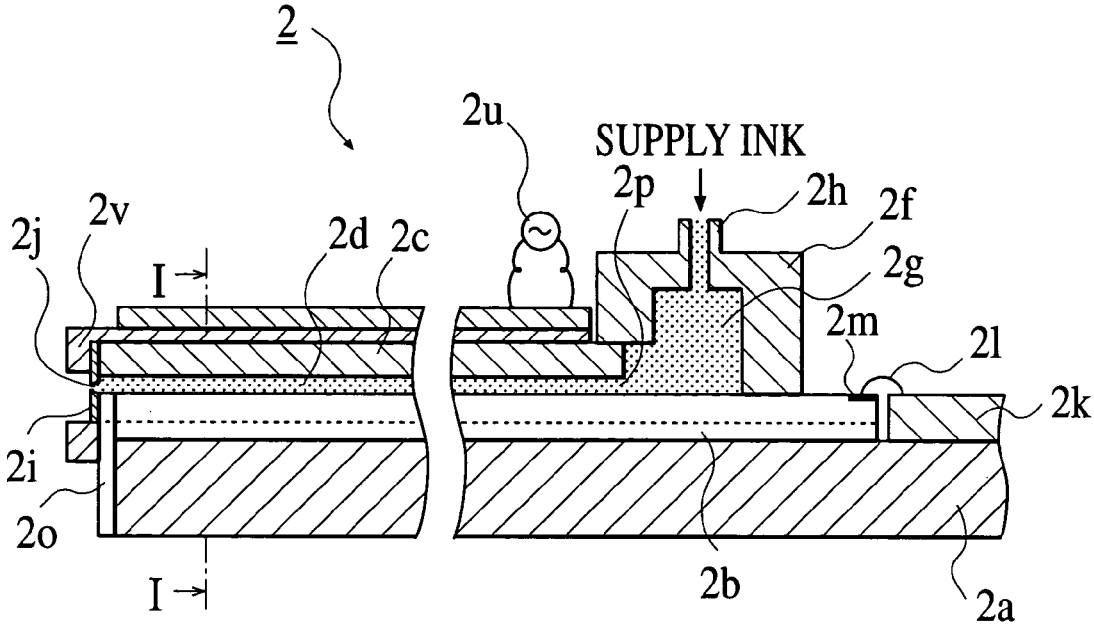
FIG. 2A is a sectional side view showing a detailed structure of a recording head 2 of the ink jet printer 100 shown in FIG. 1.
Figure 2B:
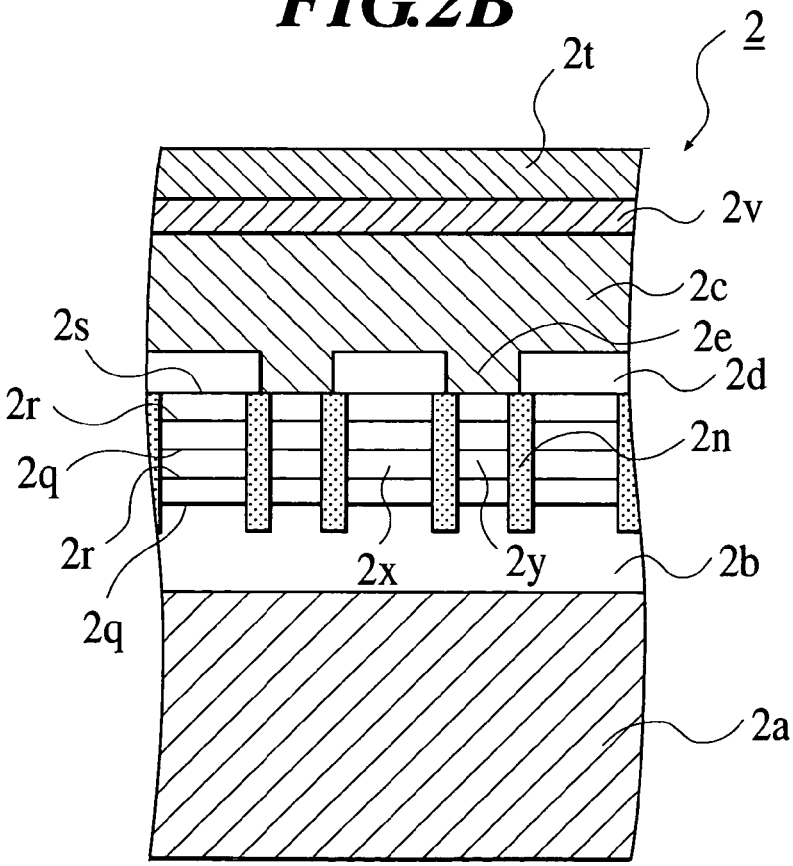
FIG. 2B is a partially enlarged view of the recording head 2 cut along I—I line in FIG. 2A.
Figure 3:
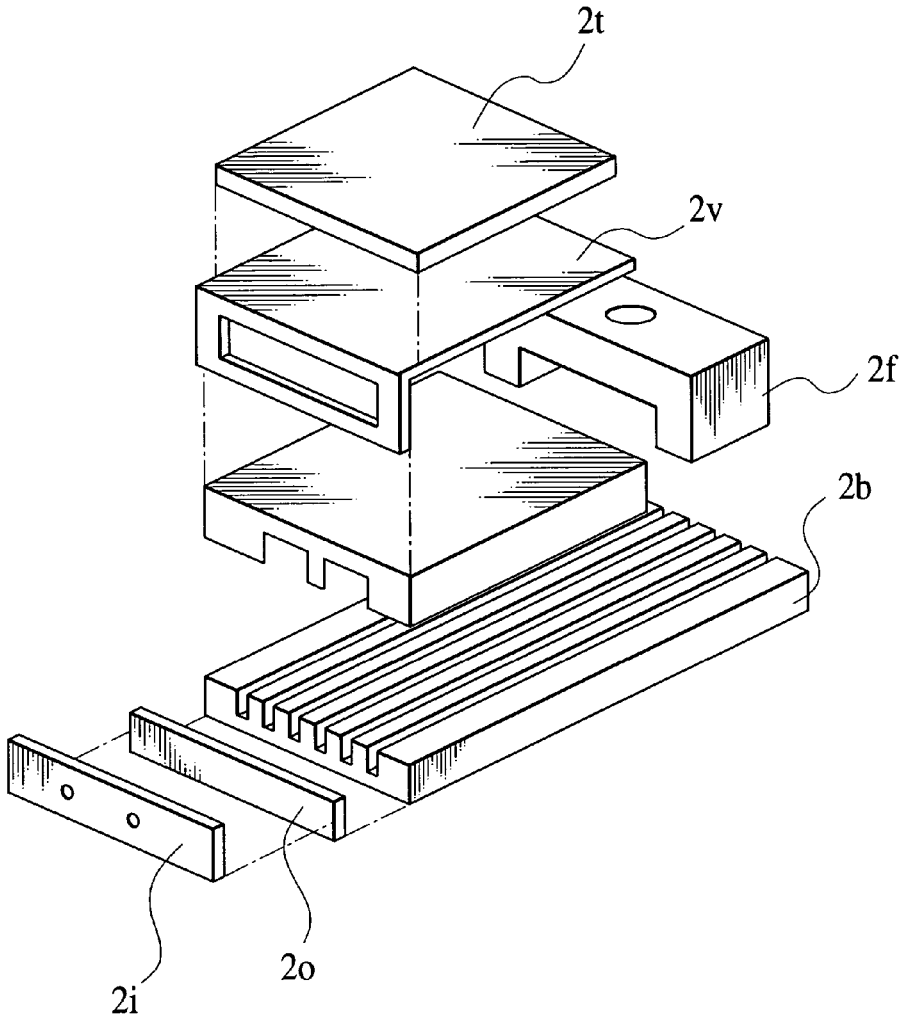
FIG. 3 is an exploded perspective view of the recording head 2.

Herein, the structure of each recording head 2 will be explained with reference to FIGS. 2A, 2B and 3. The following structure is common to all the recording heads 2. FIG. 2A is a sectional view of the recording head 2, and FIG. 2B is an enlarged view of a portion cut in I—I line of FIG. 2A. FIG. 3 is an exploded perspective view of the recording head 2.

As shown in FIGS. 2A, 2B and 3, the recording head 2 comprises a base 2*a*, a piezoelectric element 2*b*, a flow path board 2*c*, an ink flow path 2*d*, a wall portion 2*e*, a common liquid room component 2*f*, a common liquid room 2*g*, an ink supply pipe 2*h*, a nozzle plate 2*i*, a nozzle 2*j*, a driving print circuit board (PCB) 2*k*, a lead line 2*l*, a driving electrode 2*m*, grooves 2*n*, a protect board 2*o*, a fluid resistance 2*p*, electrodes 2*q* and 2*r*, an upper partition wall 2*s*, a heater 2*t*, a heater power supply 2*u*, and a heat conducting member 2*v*.

In the accumulated recording head 2, the grooves 2*n* are formed at the piezoelectric element 2*b* and the electrodes 2*q* and 2*r* which are laid on the piezoelectric element 2*b*, in the direction of the ink flow path 2*d*, so as to correspond to the ink flow path 2*d* and divide them into a driving piezoelectric element 2*x* and a non-driving piezoelectric element 2*y*. Filler is enclosed in the grooves 2*n*. The flow path board 2*c* is connected to the piezoelectric element 2*b* at which the grooves 2*n* are formed through the upper partition wall 2*s*. That is, the upper partition wall 2*s* is supported with the non-driving piezoelectric element 2*y* and the wall portion 2*e* dividing the flow paths. The width of the driving piezoelectric element 2*x* is a little narrower than the width of the ink flow path 2*d*. When a plus signal voltage is supplied to the driving piezoelectric element 2*x* selected by the driving circuit on the driving print circuit board (PCB) 2*k*, the driving piezoelectric element 2*x* is changed in the width direction. Thereby, because the volume of the ink flow path 2*d* is changed through the upper partition wall 2*s*, the ink drop is ejected from the nozzle 2*j* of the nozzle plate 2*i*.

The heater 2*t* is contacted on the flow path board 2*c* through the heat conducting member 2*v*. The heat conducting member 2*v* is extended to a nozzle surface at which an opening of the nozzle 2*j* is formed. The heat conducting member 2*v* conducts heat generated by the heater 2*v* to the flow path board 2*c* efficiently to heat ink flowing in the ink flow path 2*d*, and conducts heat generated by the heater 2*v* to around the nozzle surface to heat air around the nozzle surface. Therefore, the heat conducting member 2*v* is made of high heat conductive member, for example, preferably, metal such as aluminum, iron, nickel, copper, stainless or the like, ceramics such as SiC, BeO, AlN or the like, or the like.

When the piezoelectric element 2*b* is driven while the ink is in a liquid state, the driving piezoelectric element 2*x* is displaced in a direction perpendicular to a longitudinal direction of the ink flow path 2*d*. Therefore, because the volume of the ink flow path 2*d* is changed, ink is ejected as an ink drop from the nozzle 2*j*. That is, the signal to hold the reduced volume of the ink flow path 2*d* is always supplied to the piezoelectric element 2*b*. When the plus signal is supplied to the selected ink flow path 2 in order to displace the ink flow path 2 to reduce the volume thereof after displacing the ink flow path 2 in the direction to increase the volume thereof, ink is ejected as an ink drop from the nozzle 2*j* corresponding to the ink flow path 2*d*.

The carriage section 4 comprises the carriage 4*a* on which four recording heads 2 and four sub tanks 3 are mounted, a guide member 4*b* extending in the main scanning direction A, for guiding the carriage 4*a* to move in the main scanning direction A, a carrying belt which is not shown in figures, for moving the carriage 4*a* with holding the carriage 4*a*, and a carrying motor which is not shown in figures and is a driving source for moving the carriage 4*a*. In the carriage section 4, when the carrying motor is driven, the carrying belt moves. Therefore, the carriage 4*a* is moved in the main scanning direction A in the state the carriage 4*a* is guided by the guide member 4*b*. The moving direction of the carriage 4*a* is changed according to the rotation direction of the carrying motor. Specifically, the carriage 4*a* is moved back and forth in the main scanning direction A along the guide member 4*b* according as the recording medium 99 is carried intermittently. More specifically, the carriage 4*a* is moved back and forth in the main scanning direction A while the recording medium 99 stops.

Each of the UV radiation light sources 6 is the light irradiation section of the present invention. As described above, the UV radiation light source 6 irradiates UV radiation to ink ejected from each recording head 2 and placed on the recording medium 99. The UV radiation light sources 6 are arranged at both sides of each recording head 2 in the scanning direction A and mounted on the carriage 4*a* as shown in FIG. 4. Therefore, the UV radiation light sources 6 follow the movement of the carriage 4*a* with irradiating UV radiation to ink just after ejected from each recording head 2 and placed on the recording medium 99, while the printer 100 is carrying the recording performance. Thereby, the UV radiation light sources 6 make the ink cured immediately, and fixed on the recording medium 99.

Each UV radiation light source 6 may irradiate UV radiation continuously as described above. However, it is one of preferable methods that the UV radiation light source 6 takes two steps to irradiate UV radiation to ink. That is, the UV radiation light source 6 first irradiates UV radiation to ink in 0.001 to 2.0 seconds after the ink is placed, and further irradiates UV radiation to the ink. Because the UV radiation light source 6 takes two steps to irradiate UV radiation to ink, it is possible to prevent the shrink of the recording medium 99 caused when ink is cured. For example, the irradiation of UV radiation may be carried out by taking first UV radiation irradiation carried after ink is placed on the recording medium 99 and second UV radiation irradiation carried after the first UV radiation irradiation.

In order that each UV radiation light source 6 irradiates UV radiation, according to the present embodiment, preferably, the UV radiation light source 6 may use UV radiation having low irradiation that the maximum irradiation of the effective wavelength range in the curability of ink is 0.1 to 50 mW/cm$^2$. Usually, in order to prevent the dot from spreading and blotting just after ink is placed, the light source having high irradiation that the maximum irradiation of the effective wavelength range in the curability of ink is higher than 50 mW/cm$^2$ is used. However, in case of the irradiation, the recording medium 99 shrinks largely, and specially, a shrink label used as the recording medium 99 shrinks extremely largely. Therefore, it is impossible to use UV radiation having the maximum irradiation of higher than 50 mW/cm$^2$, substantially. According to the present invention, because an acid amplification is used, it is possible to record a high-quality image without the shrink of the recording medium 99 by using UV radiation having low irradiation that the maximum irradiation of the effective wavelength range in the curability of ink is 0.1 to 50 mW/cm$^2$. Further, it is effective to use UV radiation having irradiation that the maximum irradiation of the effective wavelength range in the curability of ink is 50 to 3000 mW/cm$^2$.

The UV radiation light source 6 may be selected from a low-pressure mercury lamp, a UV radiation laser, a xenon flush lamp, an insect lamp, a black light, a germicidal lamp, a cold-cathode tube, a LED high-pressure mercury lamp, a metal lamp halide lamp, an electrodeless UV radiation lamp, or other light source.

The humidity sensor 5 is the humidity detecting section of the present invention. The humidity sensor 5 is placed in a distance capable of detecting humidity around the ink downstream or upstream from the recording heads 2 in the sub scanning direction B, more preferably in 10 cm from the recording heads 2 within movable range of the recording heads 2, and right above the recording medium 99 carried in the sub scanning direction B. Because the humidity sensor 5 is arranged at the position, the humidity sensor 5 can detect the humidity around ink just after placed on the recording medium 99. The humidity sensor 5 used in the present embodiment, can apply a high polymer membrane humidity sensor using a high polymer membrane, a ceramic humidity sensor using a porous ceramic, an electrolytic humidity sensor using lithium chloride or other well-known humidity sensor. Further, a plurality of humidity sensors 5 may be provided at the printer 100. In the case, the plurality of humidity sensors 5 are arranged in the main scanning direction A, and the maximum humidity of humidity detected by the plurality of humidity sensors 5 is determined as the humidity around the ink.

Next, a circuit structure of the printer 100 will be explained.

FIG. 5 is a block diagram showing the circuit structure of the printer 100.

As shown in FIG. 5, a control apparatus 20 is a controller of the present invention. The control apparatus 20 comprises, as main sections, a ROM 21 for storing a control program for previously controlling each section of the printer 100, data used according to the control program or the like, a CPU 22 for performing various processing based on the control program, a RAM 23 for storing data read out of the ROM 21, data calculated by the CPU 22 according to the control program or the like.

A humidity sensor 5 is connected to the CPU 22 through an interface (hereinafter, it will be an I/F.) 24. When receiving a detection signal outputted from the humidity sensor 5, the CPU 22 controls based on the detection signal. A driving circuit 26 for driving each UV radiation light source 6 is connected to the CPU 22 through an I/F 25. The CPU 22 outputs a control signal to the driving circuit 26 to control irradiation of UV radiation irradiated from each UV radiation light source 6. Further, a driving circuit 27 for driving the display 7 is connected to the CPU 22 through the I/F 25. The CPU 22 outputs a control signal to the driving circuit 27 to make the display 7 display various screens thereon. For example, the CPU 22 makes the display 7 display a screen for showing that humidity environment or a UV radiation irradiation condition of the printer 100 is abnormal, according to humidity detected the humidity sensor 5.

Next, ink used in the present embodiment will be explained.

The ink used in the present embodiment has a property of being cured when irradiated with UV radiation. More specifically, the ink is a cationic curable type, and includes at least a cation polymeric compound which is curable through polymerization reaction when irradiated with UV radiation, a photo-cation initiator (photo acid generator) for initiating the polymerization reaction for the cation polymeric compound when irradiated with UV radiation, and colorants for coloring as ink. The ink further may include at least one of well-known various additives used for a cationic curable type of optical curable resin.

Figure 6:
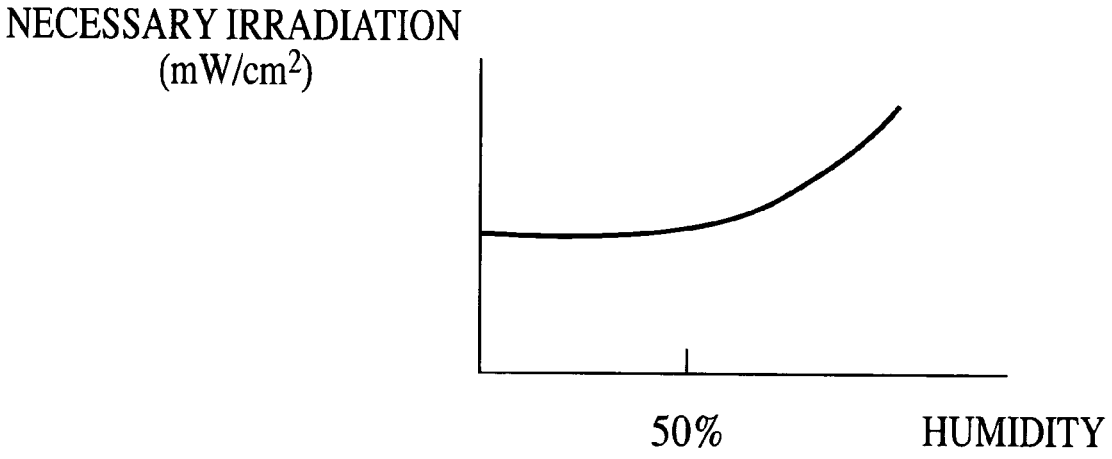
FIG. 6 is a graph showing a relationship between humidity and necessary irradiation of UV radiation to cure ink in the humidity.

Further, the ink has property that polymerization reaction is inhibited easily by humidity in air when irradiated with UV radiation. FIG. 6 is a graph showing a relationship between humidity and irradiation of UV radiation required to cure ink according to the humidity. When humidity is higher than about 50%, because the sensitivity of ink used in the present embodiment to UV radiation is lowered, it becomes difficult to cure ink. However, as shown in FIG. 6, when the irradiation of UV radiation is enhanced, ink is cured through polymerization reaction without being influenced by humidity.

Further, although the ink is curable when irradiated with UV radiation as described above, it is not limited to this. The ink is curable when irradiated with light including UV radiation. Therein, the "light" means light in a wide sense, and includes an electromagnetic wave such as UV radiation, electronic rays, X-ray, visible rays, infrared rays or the like. That is, the above-described ink may apply a cation polymeric compound which is curable through polymerization reaction when irradiated with light other than UV radiation, and a photo-cation initiator for initiating the polymerization reaction for the cation polymeric compound when irradiated with light other than UV radiation. According to the present embodiment, it will be explained that UV radiation is used as light to be irradiated to ink.

The cation polymeric compound can apply any of well-known various cation polymeric monomers. For example, epoxy compound, vinyle ether compound, oxetane compound or the like is preferable as disclosed in Japanese Patent Application Publication (Unexamined) Nos. Tokukaihei 6-9714, Tokukai 2001-31892, Tokukai 2001-40068, Tokukai 2001-55507, Tokukai 2001-310938, Tokukai 2001-310937 and Tokukai 2001-220526.

As aromatic epoxide, preferable one is di- or poly-glycidyl ether, which is synthesized by the reaction of polyhydric phenol having at least one aromatic core or alkylene oxide-added polyhydric phenol and epichlorohydrin, and for example, di- or poly-glycidyl ether of bisphenol A or of alkylene oxide-added bisphenol A, di- or poly-glycidyle ether of hydrogenated bisphenol A or of alkylene oxide-added hydrogenated bisphenol A, and novolak type epoky resion, are listed. Herein, as alkylene oxide, ethylene oxide and propylene oxide are listed.

As alicyclic epoxide, a cyclohexen oxide or cyclopentene oxide, which is obtained by epoxidation of the compound having cycloalkane ring such as at least one cyclohexen or cyclopentene ring by the appropriate oxidant such as hydrogen peroxide or peracid, is preferable.

As a preferable aliphatic epoxide, there is di- or poly-glycidyl ether of aliphatic polyvalent alcohol or of alkylene oxide-added aliphatic polyvalent alcohol, and as its representative example, di-glycidyl ether of alkylene glycol such as di-glycidyl ether of ethylene glycol, di-glycidyl ether of propylene glycol and glycidyl ether of 1, 6-hexane diol, poly-glycidyl ether of polyvalent alcohol such as di-or tri-glycidyl ether of glyceline or of alkylene oxide added glyceline, and di-glycidyl ether of polyalkylene glycol such as di-glycidyl ether of polyethylene glycol or of alkylene oxide-added polyethylene glycol, and di-glycidyl ether of polypropylene glycol or of alkylene oxide-added polypropylene glycol, are listed. Herein, as alkylene oxide, ethylene oxide and propylene oxide are listed.

In these epoxides, when the quick hardening ability is considered, aromatic epoxide and alicyclic epoxide are preferable, and particularly, alicyclic epoxide is preferable. In the present embodiment, on kind of the above epoxides may be solely used, and more than 2 kinds of them may also be used by appropriately being combined.

As a vinyl ether compound, for example, di or tri-vinyl ether compound, such as ethylene glycol di-vinyl ether, di-ethylene glycol di-vinyl ether, tri-ethylene glycol di-vinyl ether, propylene glycol di-vinyl ether, di-propylene glycol di-vinyl ether, butane diol di-vinyl ether, hexane diol di-vinyl ether, cyclohexane di-methanol di-vinyl ether, tri-methylol propane tri-vinyl ether, or mono vinyl ether compound, such as ethyl vinyl ether, n-butyl vinyl ether, iso-butyl vinyl ether, octadecyl vinyl ether, cyclohexyl vinyl ether, hydroxy butyl vinyl ether, 2-ethyl-hexyl vinyl ether, cycro-hexane di-methanol mono-vinyl ether, n-propyl vinyl ether, iso-propyl vinyl ether, iso-propenyl ether-o-propylene carbonate, dodecyl vinyl ether, or di-ethylene glycol mono vinyl ether vinyl ether, is listed.

In these vinyl ether compounds, when the hardenability, adhesion or surface hardness is considered, di or tri-vinyl ether compound is preferable, and particularly di-vinyl ether compound is preferable. In the present invention, one kind of the above vinyl ether compounds may also be used, and more than two kinds of them may also be used by being appropriately combined.

The oxetane compound preferably used in the present embodiment is a compound having the oxetane ring, and all publicly known oxetane compounds as described in Japanese Patent Application Publication (Unexamined) Nos. Tokukai 2001-220526 and Tokukai 2001-310937, can be used. This invention does not preclude fro using plural oxetane compounds in the same time.

In the compound having the oxetane ring used in the present invention, the compound having 1–4 oxetane rings is preferable. When the compound having the oxetane rings of 1 to 4 is used, because the viscosity of the composition can be kept appropriately, the handling becomes not difficult, or the glass transition temperature of the composition can be also maintained properly to use, the coking property of the hardened material becomes sufficient.

The production method of the compound having the oxetane ring is not particularly limited, and it may be conducted according to the conventionally known method, and for example, there is a synthetic method of an oxetane ring from diol disclosed by Pattison (D. B. Pattision, J.Am. Chem. Soc., 3455, 79 (1957)). Further, other than them, compounds having 1–4 oxetane rings, which have high molecular weight of molecular weight of about 1000–5000, are also listed.

In the present embodiment, in order to prevent the recording medium 99 from shrinking as ink shrinks, preferably, ink includes at least one kind of compound selected among oxetane compound, epoxy compound and vinyle ether compound as photo polymeric compound.

As the photo-cation polymeric initiator, for example, a chemical amplification type photo resist or compound used for the light cationic polymerization is used (Organic electronics material seminar "Organic material for imaging" from Bunshin publishing house (1993), refer to page 187–192). Examples preferable for the present invention will be listed below.

Firstly, aromatic onium compound $B(C_6F_5)_4$—, $PF_6$—, $AsF_6$—, $SbF_6$—, $CF_3SO_3$— salt, such as diazonium, ammonium, iodonium, sulfonium, phosphonium, can be listed. The compound including borate compound as counter anion is preferable because of high acid generative ability.

Secondly, sulfone compounds, which generate sulfonic acid, can be listed.

Thirdly, halogenide which generates hydrogen halide can also be used.

Fourthly, ferrite alien complex can be listed.

As the ink used in the present embodiment, it is preferable that an acid breeding agent, which newly generates the acid by the acid generated by the irradiation of light which is already publicly known, commencing with Japanese Patent Application Publication (Unexamined) Nos. Tokukai-hei 8-248561 and Tokukai-hei 9-034106, is included. By using the acid breeding agent, the more increase of jetting stability is made possible.

As the ink used in the present embodiment, it is preferable that a photo acid generator which is at least one selected from aromatic onium compound of diazonium, iodonium or sulfonium having aryl borate compound as counter ion, and iron allene complex is included.

As the colorants, the colorants, which can be solved or dispersed in main component of the polymeric compound, can be used, however, from the point of weather fastness, the pigment is preferable. As the pigment, the following can be used in the present embodiment, however, it is not limited to this.

C.I Pigment Yellow-1, 3, 12, 13, 14, 17, 81, 83, 87, 95, 109, 42,

C.I Pigment Orange-16, 36, 38,

C.I Pigment Red-5, 22, 38, 48: 1, 48: 2, 48: 4, 49: 1, 53: 1, 57: 1, 63: 1, 144, 146, 185, 101, C. I Pigment Violet-19, 23, C. I Pigment Blue-15: 1, 15: 3, 15: 4, 18, 60, 27, 29, C. I Pigment Green-7, 36, C. I Pigment White-6, 18, 21, C. I Pigment Black-7, Further, in the present embodiment, in order to increase the screening property of the color in the transparent recording material such as the plastic film, it is preferable that the white ink is used. Particularly, in the soft packing print, and label print, it is preferable that the white ink is used, but because the jetting amount from the recording heads 2 is large, the use amount of the white ink is limited in view of the jetting stability of the ink from the recording heads 2, and curl and wrinkle of the recording medium 99.

For the dispersion of the pigment, for example, a ball mill, a sand mill, an attritor, a roll mill, an agitator, a Henschel mixer, a colloid mill, an ultrasonic homogenizer, a Pearl mill, a wet jet mill, a paint shaker or the like may be used. Further, when the pigment is dispersed, the dispersing agent can also be added. It is preferable that, as the dispersing agent, high polymeric dispersing agent is used. As the high polymeric dispersing agent, Solsperse series of Avecia co., is listed.

Further, as the dispersion auxiliary agent, the synergist corresponding to each kind of pigment can also be used. It is preferable that 1–50 parts by weight of these dispersing agent and dispersion auxiliary agent are added to 100 parts by weight of the pigment. The dispersion medium is solvent or polymeric compound, and it is preferable that the irradiated radiation hardening type ink used in the present invention is no-solvent, because it is reacted and hardened just after the arrival of the ink. When the solvent remains in the hardened image, the problem of deterioration of solvent resistance and VOC (Volatile Organic Compound) of the remained solvent is generated. Accordingly, it is preferable in the dispersion aptitude that the dispersion medium is not solvent, but polymeric compounds, and the monomer in which the viscosity is lowest in them, is selected.

When the dispersion of the pigment is conducted, it is preferable to configure the pigment, dispersing agent, selection of diluent for the dispersion so that average particle size of the pigment become 0.08–0.5 μm, more preferably 0.3–10 μm, still more preferably, 0.3–3 μm. By this particle size control, the nozzle plugging of the inkjet head is suppressed, and the preservation stability of the ink, ink transparency and hardening sensitivity can be maintained.

It is preferable that the density of the colorant is 1 weight % to 10 weight % of the ink used in the present embodiment.

Various additive agents other than the above-described components can be used in the ink used in the present embodiment. For example, in order to increase the keeping quality of the ink components, the polymerization inhibitor of 200–20000 ppm can be added. Because it is preferable that the ultraviolet ray hardenable type ink is heated and made to low viscosity, and jetted, it is preferable for preventing the head from plugging by the thermal polymerization that the polymerization inhibitor is added. Other than that, corresponding to the necessity, the surfactant, leveling additive agent, mat agent, polyester resin for adjusting the film property, polyurethane resin, vinyl resin, acrylic resin, rubber resin, or wax can be added.

In order to improve the adhesion to the recording medium 99, it is also effective that the very fine amount of organic solvent is added. In this case, the addition within the range that the problem of the solvent resistance or VOC (volatile organic compound) is not generated, is effective, and the amount is 0.1–5 weight %, preferably 0.1–3 weight % of total ink weight. Further, it is also possible that the radical polymeric monomer and the initiator are combined, and the hybrid type hardening ink of the radical and cation is made.

According to the embodiment, it is preferable that a total thickness of the ink which is placed on the recording medium 99, irradiated with UV radiation and cured, is 2–20 μm. In the field of screen image recording, the total thickness of the ink is more than 20 μm in the present. However, in the field of the soft packing print using thin plastic material as the recording medium 99, the ink more than 20 μm in thickness can be used because of not only problems with curl and wrinkle of the recording medium 99 but also problems of change in tension and texture of the whole image recorded matter.

Further, according to the embodiment, it is preferable that the amount of a drop of ink ejected from each recording head 2 is 2–15 pl. In order to record high-quality images, it is necessary that the amount of a drop of ink is determined within the range of 2–15 pl. However, in case the 2–15 pl ink is ejected per drop, specially, because the jetting stability of the ink from each recording head 2 becomes severe, an acid breeding agent is necessary.

Further, according to the embodiment, it is preferable that the ink is irradiated with UV radiation in 0.001–2.0 seconds after the ink is placed on the recording medium 99, more preferably in 0.001–1.0 second, as the irradiation condition of UV radiation irradiated from the UV radiation light sources 6 to the ink. In order to record high-quality images, in particular, it is important that the irradiating timing is as soon as possible.

Next, the recording medium 99 used in the present embodiment will be explained.

The recording medium 99 used in the embodiment is made of material such as various papers, various cloth, various non-woven cloth, a resin film, metal, glass or the like. The recording medium 99 can be formed in a roll-like shape, a cut-sheet-like shape, a plate-like shape or the like.

Specially, the recording medium 99 used in the embodiment can apply various non-absorptive plastic and a film made of non-absorptive plastic used in so-called soft packing. For example, as various plastic films, a PET (polyethylene terephthalate) film, an OPS (oriented polystyrene) film, an OPP (oriented polypropylene) film, a ONy (oriented nylon) film, a PVC (oriented poly vinyl chloride) film, a PE (polyethylene) film, and a TAC (triacetyl cellulose) film can be listed. As the other plastic films, polycarbonate, acrylic resin, ABS (acrylonitorile butadiene styrene), polyacetal, PVA (poly vinyl alcohol), rubber or the like, can be used.

In order to record the image on a PET film, an OPS film, an OPP film, an ONy film, or a PVC film capable of shrinking with heat among the above-described films, specially, the structure in the embodiment is effective. The reason is that not only this type of recording medium 99 is curled or transformed easily because of heat when ink is cured and shrinks or cured through reaction or the like, but also the film of ink does not follow easily as the shrink of the ink.

According to the present embodiment, it is possible to record a good and high-quality image on the recording medium 99 having surface energy covering a wide range of 35–60 mN/m, including an OPP film or an OPS film having low surface energy, and a PET film having relatively high surface energy.

Further, according to the present embodiment, it is more advantageous to use a web of the recording medium 99 in view of cost of the recording medium 99 such as packing cost, production cost or the like, printing efficiency, printable various sizes or the like.

Next, the operation of the printer 100 will be explained.

While the printer 100 is performing the recording operation, when the carrying section and the fan of the platen 11 operate, the recording medium 99 is carried in the sub scanning direction B intermittently in order, in a state the platen 11 vacuums and holds the recording medium 99. When the recording medium 99 stops, the carriage section 4 operates, and the carriage **4*a* moves right above the recording medium 99 in the main scanning direction A right. While the carriage 4*a* is moving right above the recording medium 99, each recording head 2 ejects ink to the recording medium 99. The ejected ink is placed on the recording medium 99. When the ink just after placed on the recording medium 99 is irradiated and cured with UV radiation emitted from the UV radiation light sources 6 arranged next to the recording heads 2, a dot is formed on the recording medium 99. Hereinafter, when the printer 100 performs the above-described operation continuously, the desired image is recorded on the recording medium 99** in order.

Herein, when the printer 100 performs the above-described operation continuously, the humidity sensor 5 detects the humidity around ink just after placed on the recording medium 99. Thereby, the control apparatus 20 controls irradiation of UV radiation emitted from each UV radiation light source 6.

Figure 7:
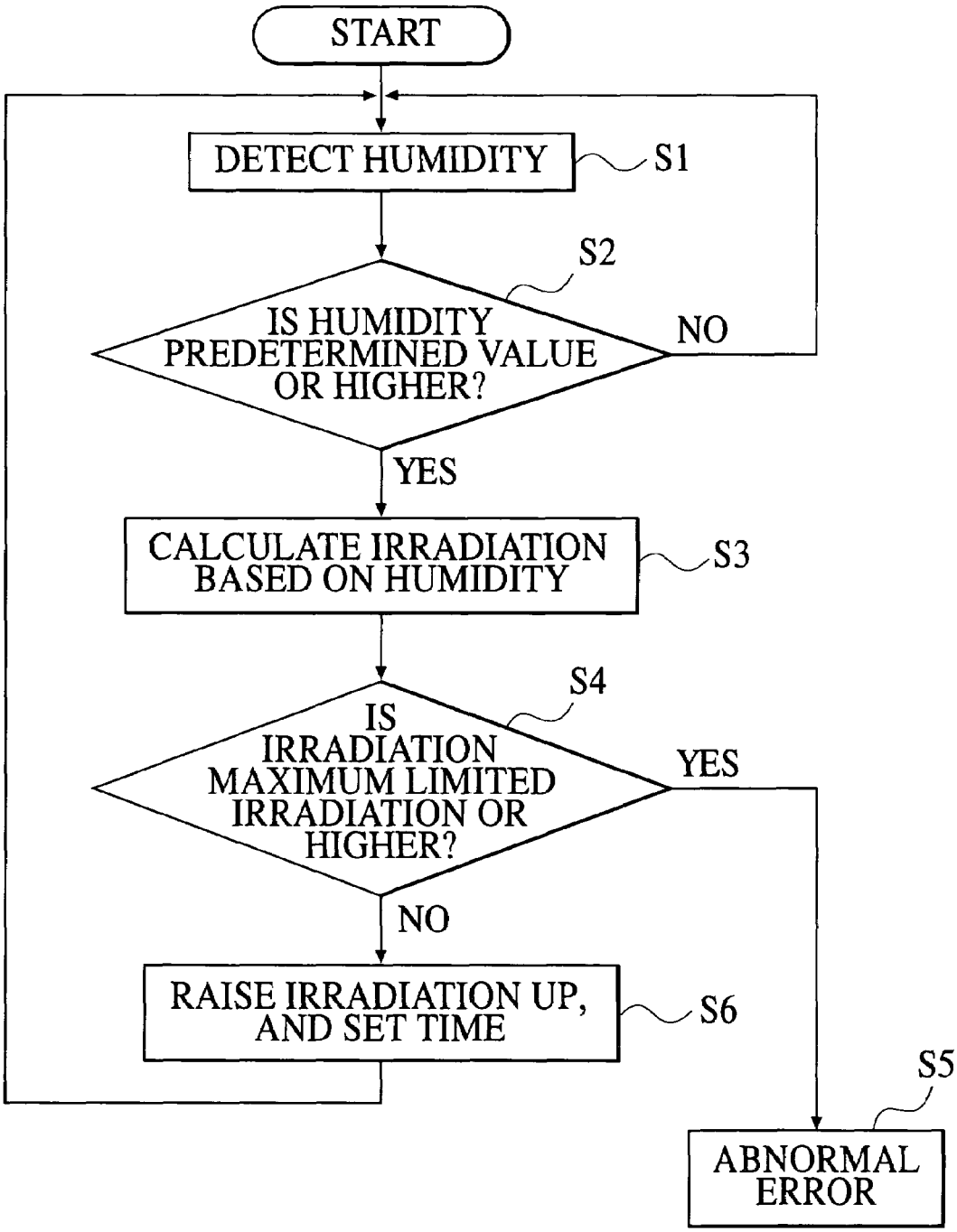
FIG. 7 is a flow chart for controlling irradiation of UV radiation irradiated from the UV radiation light sources 6.

Hereinafter, the control over irradiation of UV radiation emitted from each UV radiation light source 6 will be explained with reference to FIG. 7. FIG. 7 is a flow chart for controlling irradiation of UV radiation emitted from each UV radiation light source 6.

While the printer 100 is operating, the humidity sensor 5 detects humidity around ink just after placed on the recording medium 99, and outputs a detection result (detection signal) to the CPU 22 of the control apparatus 20 (Step S1). The CPU 22 of the control apparatus 20 determines whether or not the humidity (hereinafter, it will be detected humidity.) detected by the humidity sensor 5 is predetermined humidity (for example, 50%) or higher on the basis of the detection signal outputted from the humidity sensor 5 (Step S2).

When the detected humidity is lower than the predetermined humidity (Step S2; NO), the CPU 22 performs the processing in Step S1. When the detected humidity is the predetermined humidity or higher (Step S2; YES), the CPU 22 calculates irradiation of each UV radiation light source 6 to cure ink on the basis of the detected humidity (Step S3).

As explained in detail, a conversion table showing a relationship between detected humidity and irradiation and irradiation time of UV radiation corresponding to each detected humidity (in order to polymerize and cure ink effectively) is stored in the ROM 21 of the control apparatus 20. Therefore, the CPU 22 calculates the irradiation and the irradiation time according to the detected humidity by using the conversion table.

After the processing in Step S3, the CPU 22 determines whether or not the irradiation calculated in Step S3 is the maximum limited irradiation or higher (Step S4). The maximum limited irradiation is irradiation of UV radiation which each UV radiation light source 6 can irradiate, and the upper limit of irradiation without having a bad influence such as the shrink, the distortion or the like on the recording medium 99, in consideration of electricity consumption, life span or the like of each UV radiation light source 6. The maximum limited irradiation can be changed according to applied ink, the type of the recording medium 99 or the like, properly.

In Step S4, when the irradiation calculated based on the detected humidity is the maximum limited irradiation or higher (Step S4; YES), the CPU 22 performs error processing when humidity environment or a UV radiation irradiation condition is abnormal (Step S5).

In Step S4, when the irradiation calculated based on the detected humidity is lower than the maximum limited irradiation (Step S4; NO), the CPU 22 raises the irradiation of UV radiation irradiated from each UV radiation light source 6 to the irradiation calculated based on the detected humidity, and sets the irradiation time calculated based on the detected humidity (Step S6). Therefore, the irradiation of UV radiation irradiated from each UV radiation light source 6 is raised, and each UV radiation light source 6 irradiates UV radiation having the calculated irradiation only during the set irradiation time. After the processing in Step S6, the CPU 22 returns to the processing in Step S1 to control irradiation of UV radiation irradiated from each UV radiation light source 6 continuously, as described above.

According to the above-described printer 100, when the humidity sensor 5 detects humidity around ink placed on the recording medium 99, the CPU 22 controls to raise irradiation of UV radiation to be irradiated from each UV radiation light source 6 only when the detected humidity is predetermined humidity or higher on the basis of the detection result detected by the humidity sensor 5. Consequently, UV radiation is not irradiated to the recording medium 99 more than necessary. As a result, it is possible to cure ink without having influence on the ink with preventing the raise in temperature of the recording medium 99 caused by irradiating UV radiation.

In particular, it becomes difficult to cure ink used in the present embodiment in case the humidity around the ink placed on the recording medium 99 is about 50% or higher, as described with reference to FIG. 6. Accordingly, only in the case the detected humidity is 50% or higher, it is preferable to control to raise irradiation of UV radiation irradiated from each UV radiation light source 6.

Although the present invention has been explained according to the above-described embodiment, it should also be understood that the present invention is not limited to the embodiment and various changed and modifications may be made to the invention without departing from the gist thereof.

For example, the example that the UV radiation light sources 6 are arranged at both sides of each recording head 2 has been shown in the present embodiment. However, the UV radiation light sources 6 may be mounted at both sides of the carriage 4*a* in the main scanning direction A, one UV radiation light source 6 may be mounted at only one side of the carriage 4*a* in the main scanning direction A, or the UV radiation light sources 6 may be fixed at the printer 100 in substantially all the width of the recording medium 99. In case the UV radiation light sources 6 are fixed at the printer 100 in substantially all the width of the recording medium 99, it is required to provide the UV radiation light sources 6 downstream from each recording head 2 in the sub scanning direction B. The reason is that it is required to irradiate UV radiation to ink just after placed on the recording medium 99.

Further, the example that the recording heads 2 mounted on the carriage 4*a* record the image has been shown in the present embodiment. However, a line head fixed at the printer 100 in substantially all the width of the recording medium 99 to be carried may be applied instead of the recording heads 2. In the case, it is required to arrange the UV radiation light sources 6 in substantially all the width of the recording medium 99 downstream from the line head in the sub scanning direction B. According to this structure, it is possible to obtain the same effect as one in the present embodiment.

According to the present invention, it is possible to enhance the curability of ink with preventing the raise in temperature of the recording medium as possible.

[Second Embodiment]

Figure 8:
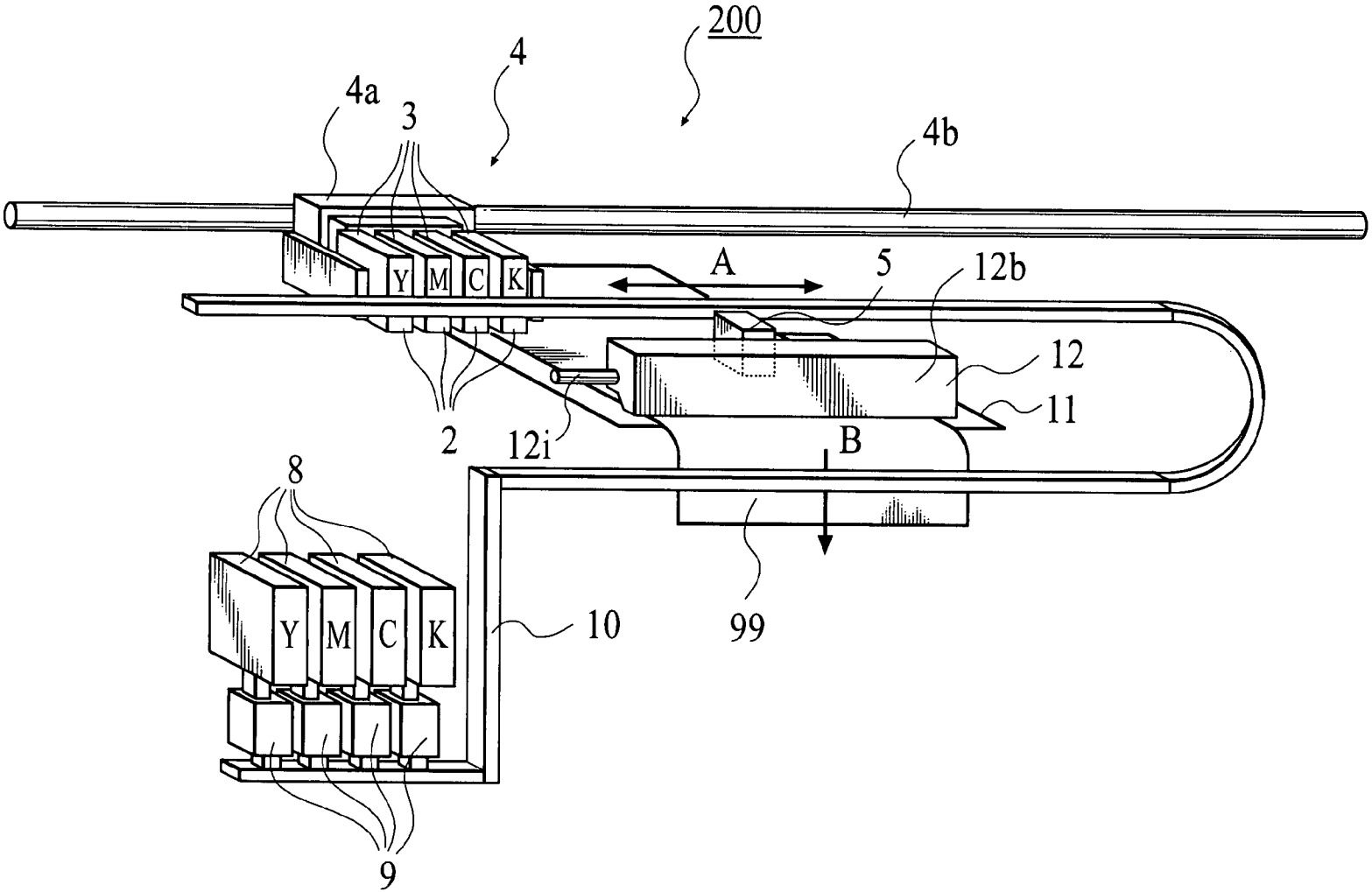
FIG. 8 is a perspective view showing a schematic structure of an ink jet printer 200 according to a second embodiment of the present invention.

FIG. 8 is a perspective view showing a schematic structure of a printer 200 according to the second embodiment.

As shown in FIG. 8, the printer 200 has, as main components, substantially the same structure as one of the printer 100 in the first embodiment, and further comprises a dehumidifier 12 for dehumidifying humidity in air, and a control apparatus 20' for controlling operation of the dehumidifier 12. Therefore, the same reference numerals are attached to the same elements as corresponding elements in the first embodiment, and it is omitted to explain them. Further, the control apparatus 20' has substantially the same structure as one of the control apparatus 20 in the first embodiment besides one capable of controlling operation of the dehumidifier 12, and will be explained in detail as follows.

Figure 9:
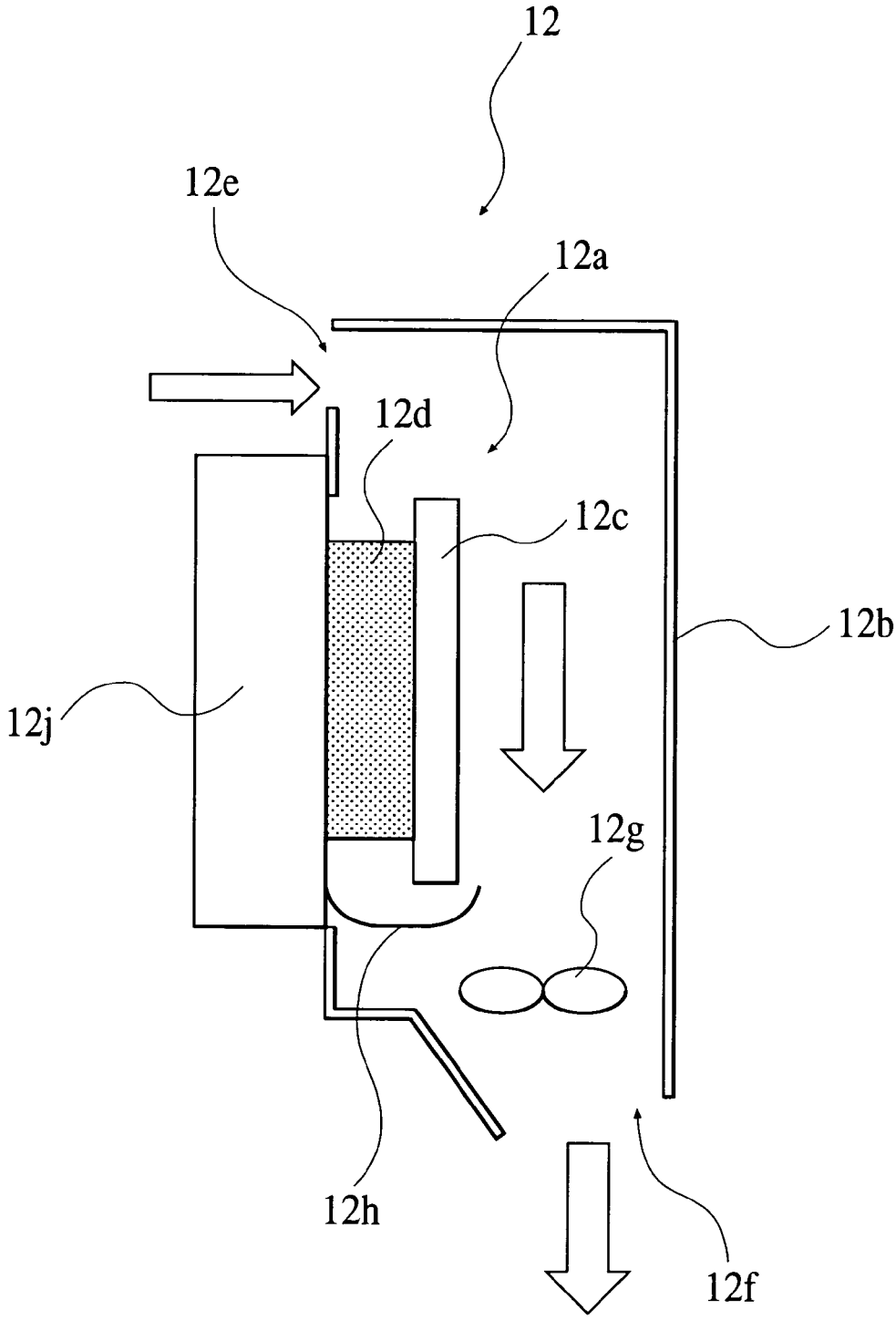
FIG. 9 is a sectional side view showing a detailed structure of a dehumidifier 12 of the ink jet printer 200 shown in FIG. 8.

The dehumidifier 12 is the dehumidifying section of the present invention. The dehumidifier 12 is placed in a distance capable of dehumidifying humidity around ink downstream or upstream from the recording heads 2 in the sub scanning direction B, more preferably in 10 cm from the recording heads 2 within movable range of the recording heads 2, and right above the recording medium 99 carried in the sub scanning direction B, like the above-described humidity sensor 5. Further, the dehumidifier 12 is placed in substantially all the width of the recording medium 99 to be carried. FIG. 9 is a sectional side view showing a detailed structure of the dehumidifier 12.

As shown in FIG. 9, the dehumidifier 12 is a member covering a Peltier device 12*a* for causing endothermic reaction and exothermic reaction with a covering body 12*b*. The Peltier device 12*a* is an electronic cooling device of the present invention, and comprises a heat absorbing unit 12*c* for causing endothermic reaction when driving and a heating unit 12*d* for causing exothermic reaction when driving. A heat radiation plate 12*j* for radiating heat is provided at a back surface side of the Peltier device 12*a*. An inflow port 12*e* into which air in the open-air flows is provided at an upper portion of the covering body 12*b*, and an outflow port 12*f* from which air in the covering body 12*b* flows is provided at a lower portion of the covering body 12*b*. The inflow port 12*e* and the outflow port 12*f* are long ventholes in a longitudinal direction of the covering body 12*b*, and in substantially all the width of the recording medium 99 to be carried. The recording medium 99 is carried so as to pass right under the outflow port 12*f*.

A ventilator fan 12*g* is provided around the outflow port 12*f* and a drainage duct 12*h* is provided below the Peltier device 12*a* in an inside of the covering body 12*b*, besides the Peltier device 12*a*. The drainage duct 12*h* is connected to a drainage duct pipe 12*i* so as to project from the covering body 12*b* to the outside, as shown in FIG. 8.

When the dehumidifier 12 comprising the above-described structure operates, the ventilator fan 12*g* rotates so that air in the open-air flows through the inflow port 12*e* into the inside of the covering body 12*b* and then flows from the outflow port 12*f* (shown by arrows in FIG. 9). At the time, because voltage is supplied to the Peltier device 12*a*, the endothermic reaction occurs in the heat absorbing unit 12*c*, and the exothermic reaction occurs in the heating unit 12*d*.

In more detailed, as the Peltier device 12*a* operates, because air around the heat absorbing unit 12*c* is cooled down suddenly, a drop of water adheres to a surface of the heat absorbing unit 12*c*. Therefore, the drop of water drops into the drainage duct 12*h* and finally is drained from the drainage duct pipe 12*i* shown in FIG. 8. Thereby, when the air flowing through the inflow port 12*e* into the inside of the covering body 12*b* is dehumidified, dry air flows through the outflow port 12*f* from the covering body 12*b* to the outside to be sent to the recording medium 99. On the other hand, the heat generated by the heating unit 12*d* is conducted to the heat radiation plate 12*j* to radiate into the open-air. Through the above-described reaction, the dehumidifier 12 converts the air around the dehumidifier 12 into the dry air.

A plurality of Peltier devices 12*a* may be provided at the inside of the covering body 12*b* in the longitudinal direction of the covering body 12*b*. As well, a plurality of ventilator fans 12*g* may be provided at the inside of the covering body 12*b* in the longitudinal direction of the covering body 12*b*.

Next, a circuit structure of the printer 200 will be explained.

Figure 10:
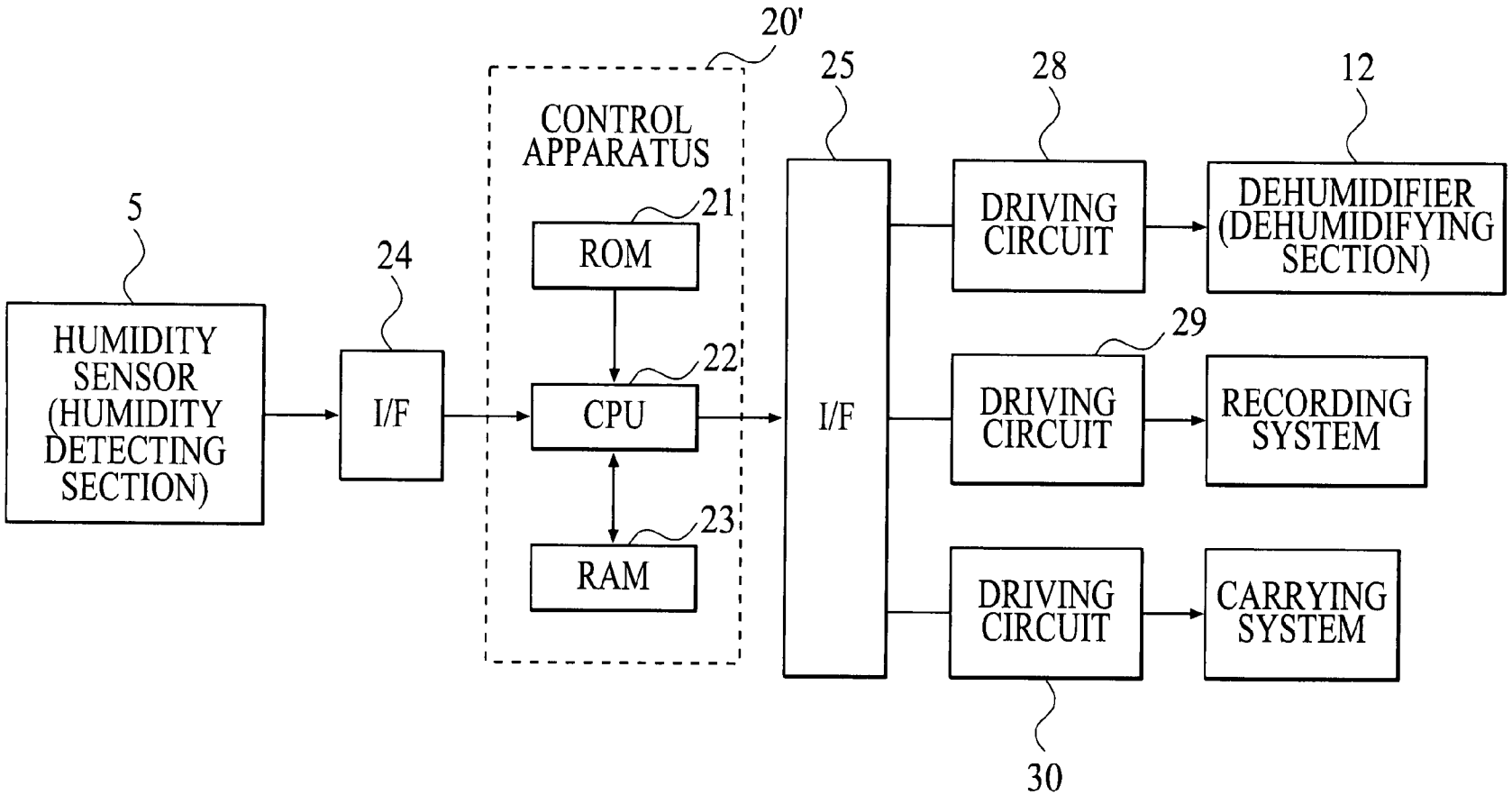
FIG. 10 is a block diagram showing a circuit structure of the ink jet printer 200.

FIG. 10 is a block diagram showing the circuit structure of the printer 200.

As shown in FIG. 10 the control apparatus 20' has substantially the same structure of one of the control apparatus 20 in the first embodiment. Further, a driving circuit 28 for driving the dehumidifier 12 is connected to the CPU 22 through the I/F 25. The CPU 22 outputs a control signal to the driving circuit 28 to control operation of the dehumidifier 12. Furthermore, driving circuits 29 and 30 for a recording system for recording images such as each recording head 2, the carriage 4*a*, each UV radiation light source 6 or the like and a carrying system for carrying the recording medium 99 such as the carrying section or the like, are connected to the CPU 22 through the I/F 25. The CPU 22 outputs control signals to the driving circuits 29 and 30 to control operation of the recording system and the carrying system.

Next, ink used in the second embodiment will be explained.

Figure 11:
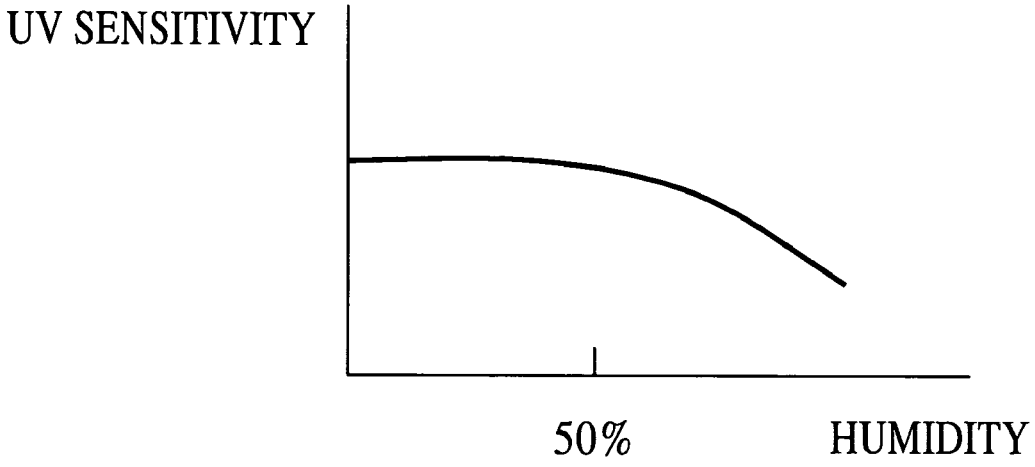
FIG. 11 is a graph showing a relationship between humidity and sensitivity of ink to UV radiation in the humidity.

The ink used in the second embodiment is substantially the same as one used in the first embodiment, and has property that polymerization reaction is inhibited easily by humidity in air when irradiated with UV radiation. FIG. 11 is a graph showing a relationship between humidity and sensitivity of ink to UV radiation in the humidity. As shown in FIG. 11, because the sensitivity of ink used in the second embodiment to UV radiation is lowered when humidity is higher than about 50%, it becomes difficult to cure the ink. However, when the ink is irradiated with UV radiation with keeping it's own temperature in predetermined temperature or higher after placed on the recording medium 99 until irradiated with UV radiation, it is possible to polymerize and cure the ink effectively, without being affected by humidity.

Next, the operation of the printer 200 will be explained.

Like the printer 100 in the first embodiment, while the printer 200 is performing the recording operation, when the carrying motor of the carrying section, the fan of the platen 11 or the like operates, the recording medium 99 is carried in the sub scanning direction B intermittently in order, in a state the platen 11 vacuums and holds the recording medium 99. Therefore, when the ink is placed on the recording medium 99, a dot is formed on the recording medium 99. Hereinafter, when the printer 200 performs the above-described operation continuously, the desired image is recorded on the recording medium 99 in order.

Herein, when the printer 200 performs the above-described operation continuously, the humidity sensor 5 detects humidity around ink just after placed on the recording medium 99. Thereby, the control apparatus 20' controls humidity environment so that the humidity around ink just after placed is predetermined humidity.

Figure 12:
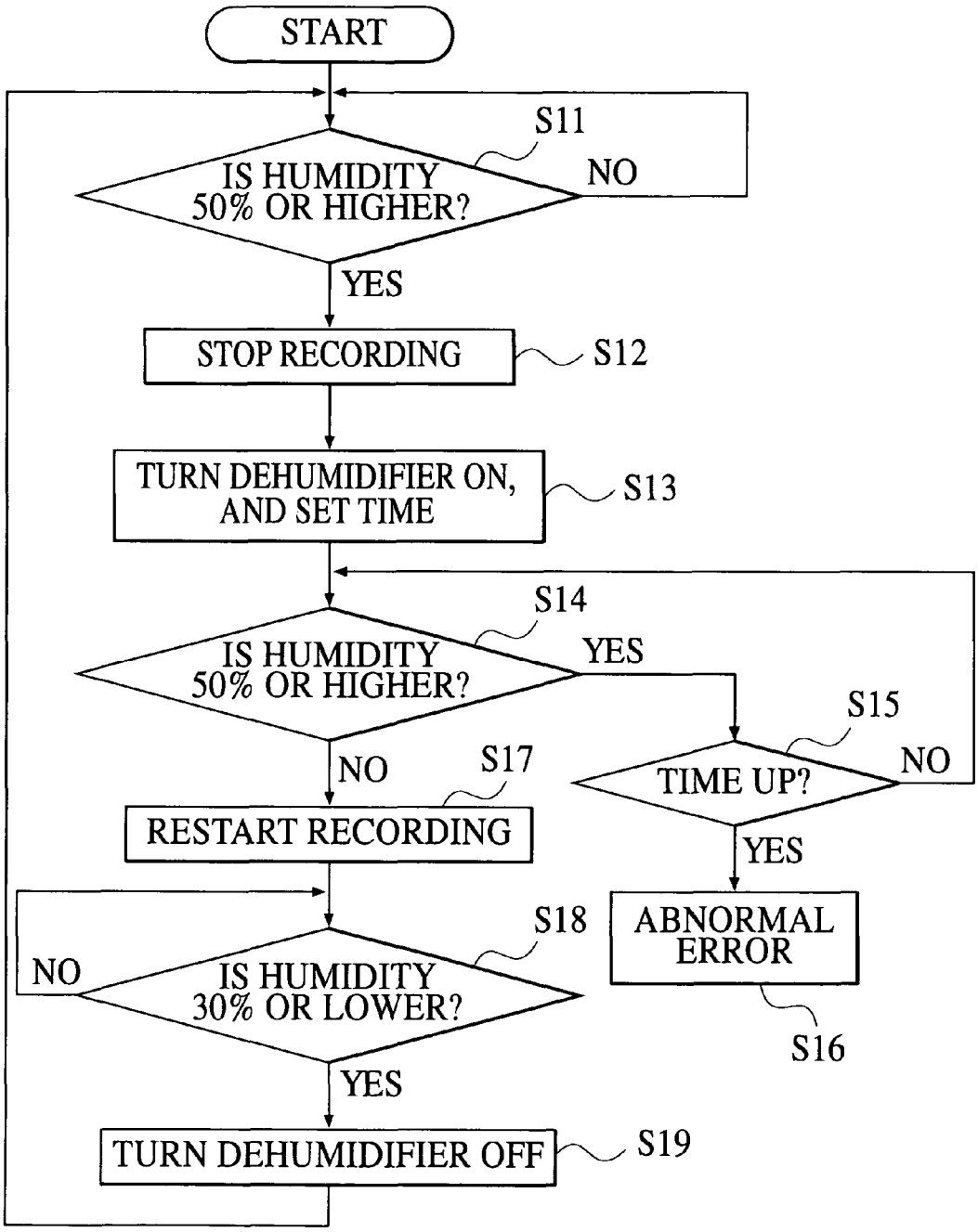
FIG. 12 is a flow chart for controlling humidity around ink just after the ink placed on a recording medium.

Hereinafter, the control over humidity environment will be explained with reference to FIG. 12. FIG. 12 is a flow chart for controlling humidity around ink just after placed on the recording medium 99.

While the printer 200 is operating, when the humidity sensor 5 detects humidity around ink just after placed on the recording medium 99, the humidity sensor 5 always outputs a detection result (detection signal) to the CPU 22 of the control apparatus 20'. The CPU 22 of the control apparatus 20' determines whether or not humidity (hereinafter, it will be called detected humidity.) detected by the humidity sensor 5 is 50% or higher on the basis of the detection signal of the humidity sensor 5 (Step S11).

When the detected humidity is lower than 50% (Step S11; NO), the CPU 22 performs the processing in Step S11 continuously. When the detected humidity is 50% or higher (Step S11; YES), the CPU 22 outputs control signals to stop the operation of the recording system and the carrying system to the driving circuits 29 and 30 to make the recording system and the carrying system stop operating (Step S12). In the case, the CPU 22 stops the operation of the recording system and the carrying system after finishing recording the image on the way to be recorded. The reason is that when the CPU 22 interrupts recording the image, there occurs unevenness between the dot formed just before the interruption and the dot formed just after the interruption so that the quality of the image is lowered. Further, even when the detected humidity becomes 50% or higher on the way to record the image, because it is difficult to expect to change humidity suddenly, a problem with the quality of the image is not caused.

After performing the processing in Step S12, the CPU 22 outputs the control signal to drive the dehumidifier 12 to the driving circuit 28 to make the dehumidifier 12 operate (Step S13). In the case, the CPU 22 performs processing for determining operation time of the dehumidifier 12 according to the detection signal of the humidity sensor 5. That is, the operation time of the dehumidifier 12 is determined to be longer according to the amount that the detected humidify exceeds 50%.

After performing the processing in Step S13, the CPU 22 performs the same processing as one in Step S11 again (Step S14) When the detected humidity is 50% or higher (Step S14; YES), the CPU 22 determines whether or not the operation time of the dehumidifier 12 reaches the operation time determined by performing the processing in Step S14 (Step S15). When the operation time of the dehumidifier 12 exceeds the determined operation time (Step S15), the CPU 22 performs error processing when the humidity environment is abnormal (Step S16). When the operation time of the humidifier 12 is within the determined operation time (Step S15; NO), the CPU 22 returns to the processing in Step S14.

In the processing in Step S14, when the detected humidity is lower than 50% (Step S14; NO), the CPU 22 outputs the control signal to restart the operation of the recording system and the carrying system to the driving circuits 29 and 30 to make the recording system and the carrying system restart operating (Step S17). In the case, because the dehumidifier 12 keeps operating, the ventilator fan 12*g* is rotating and the voltage is supplied to the Peltier device 12*a*. Therefore, the humid air that the detected humidity is 50% or higher flows into the inside of the covering body 12*b*, and then is converted to the dehumidified dry air. Thereby, when the dry air is sent around ink just after placed on the recording medium 99 on which the recording of the image is started, the image is kept recorded on the recording medium 99 in the humidity environment less than 50%.

After performing the processing in Step S17, the CPU 22 determines whether or not the detected humidity is 30% or lower on the basis of the detection signal of the humidity sensor 5 (Step S18).

When the detected humidity is higher than 30% (Step S18; NO), the CPU 22 performs the processing in Step S18. When the detected humidity is 30% or lower (Step S18; YES), the CPU 22 outputs the control signal to stop the operation of the dehumidifier 12 to the driving circuit 28 to make the dehumidifier 12 stop operating (Step S19). Because the CPU 22 performs the processing for determining the operation time of the dehumidifier 12 in the processing in Step S13, when the operation time reaches the determined operation time before the detected humidity becomes lower than 30%, the dehumidifier 12 stops operating automatically. After performing the processing in Step 19, the CPU 22 returns to the processing in Step S11, and controls the humidity environment as described above.

In the above-described printer 200, the humidity sensor 5 detects humidity around ink just after placed on the recording medium 99, and the CPU 22 of the control apparatus 20' controls the operation of the dehumidifier 12 on the basis of the detection signal of the humidity sensor 5. Consequently, it is possible to record images in the state that the portion around the ink just after placed on the recording medium is kept in the humidity environment that the humidity is about 30% to 50%.

In the case, because the portion around the ink just after placed on the recording medium 99 is kept in the humidity environment that the humidity is about 50% or lower, as understood with reference to FIG. 11, the ink just after placed on the recording medium 99 can be cured by being irradiated with UV radiation, without almost lowering the sensitivity to UV radiation.

Further, the air inflowing into the inside of the covering body 12*b* of the dehumidifier 12 is converted to the dry air dehumidified by the Peltier device 12*a*, cooled down by the Peltier device 12*a*, and further sent to the recording medium 99. Consequently, it is possible to certainly prevent the temperature of the recording medium 99 irradiated with UV radiation emitted from each UV radiation light source 6 from rising. In the case, because the outflow port 12*f* of the dehumidifier 12 is provided in substantially all the width of the recording medium 99, it is possible to equally dehumidify the portion around the ink placed on the recording medium 99 in substantially all the width of the recording medium 99 by sending the dry air from the dehumidifier 12 to the recording medium 99 in substantially all the width of the recording medium 99.

As a result, it is possible to cure ink with preventing the raise in temperature of the recording medium 99 as possible.

Although the present invention has been explained according to the above-described second embodiment, it should also be understood that the present invention is not limited to the embodiment and various changed and modifications may be made to the invention without departing from the gist thereof.

For example, like the first embodiment, the example that the UV radiation light sources 6 are arranged at both sides of each recording head 2 has been shown in the second embodiment. However, the UV radiation light sources 6 may be mounted at both sides of the carriage 4*a* in the main scanning direction A, one UV radiation light source 6 may be mounted at only one side of the carriage 4*a* in the main scanning direction A, or the UV radiation light sources 6 may be fixed at the printer 200 in substantially all the width of the recording medium 99. In case the UV radiation light sources 6 are fixed at the printer 200 in substantially all the width of the recording medium 99, it is required to provide the UV radiation light sources 6 downstream from each recording head 2 in the sub scanning direction B. The reason is that it is required to irradiate UV radiation to ink just after placed on the recording medium 99.

Further, the example that the recording heads 2 mounted on the carriage 4*a* record the image has been shown in the second embodiment. However, a line head fixed at the printer 200 in substantially all the width of the recording medium 99 to be carried may be applied instead of the recording heads 2. In the case, it is required to arrange the UV radiation light sources 6 in substantially all the width of the recording medium 99 downstream from the line head in the sub scanning direction B. According to this structure, it is possible to obtain the same effect as one in the present embodiment.

According to the present invention, it is possible to enhance curability of ink in a state that the raise in temperature of the recording medium 99 is prevented as possible.

Further, it is possible to provide a period that the dehumidifier 12 does not operate. Consequently, because the period that the dehumidifier 12 does not operate is provided, it is possible to reduce electricity consumption required to drive the dehumidifier 12 by one for the period.

Further, it is possible to equally dehumidify the portion around ink placed on the recording medium 99 in substantially all the width of the recording medium 99.

Further, it is possible to cool down the recording medium 99, and to prevent the raise in temperature of the recording medium 99 irradiated with light emitted from the UV radiation light sources 6.

Further, it is possible to certainly prevent the raise in temperature of the recording medium 99 irradiated with light emitted from the UV radiation light sources 6.

The entire disclosures of Japanese Patent Application Nos. Tokugan 2002-256154 filed on Aug. 30, 2002, and Tokugan 2002-256151 filed on Aug. 30, 2002 including specifications, claims, drawings and summaries are incorporated herein by reference in their entirety.

What is claimed is:

1. An ink jet printer for recording a desired image on a recording medium by ejecting ink which includes a cationic polymerization component and which is curable when irradiated with UV light to the recording medium, the printer comprising:

a recording head for ejecting the ink to the recording medium;

a UV light irradiation section for irradiating with UV light the ink placed on the recording medium;

a humidity detecting section for detecting humidity around the ink placed on the recording medium; and a controller for controlling irradiation of the UV light to be irradiated from the UV irradiation section on the basis of detected humidity detected by the humidity detecting section, wherein the controller has a conversion table showing a relationship between the detected humidity detected by the humidity detecting section around the ink placed on the recording medium, and a desired UV irradiation and a desired irradiation time corresponding to the detected humidity, wherein the controller comprises a central processing unit, and performs processing for calculating the desired UV irradiation of the UV light irradiation section and the desired irradiation time corresponding to the detected humidity by using the conversion table with the central processing unit, the controller determining whether the calculated desired UV irradiation is higher than a maximum limited UV irradiation of the UV light irradiation section by performing the processing for calculating the desired UV irradiation and the desired irradiation time corresponding to the detected humidity around the ink placed on the recording medium by using the conversion table, and wherein the central processing unit of the controller informs of abnormality of at least one of humidity environment condition and a UV light irradiation condition when determining that the desired UV irradiation calculated based on the detected humidity is not lower than the maximum limited UV irradiation.

2. The printer of claim 1, wherein the conversion table is determined on the basis of sensitivity of the ink to the UV light.

3. The printer of claim 2, wherein the controller changes the conversion table according to a type of the ink.

4. The printer of claim 1, wherein the controller determines a plurality of values of the maximum limited UV irradiation on the basis of a type of the recording medium.

5. The printer of claim 4, wherein the controller selects the maximum limited UV irradiation among the plurality of values of the maximum limited UV irradiation on the basis of the type of the recording medium.

6. The printer of claim 1, further comprising a display section for displaying a screen for informing of the abnormality of at least one of humidity environment and the UV light irradiation condition according to an instruction of the central processing unit.

7. The printer of claim 1, wherein the UV light irradiation section irradiates the UV light of the desired UV irradiation for the desired irradiation time.

8. An ink jet printer for recording a desired image on a recording medium by ejecting ink to the recording medium, the ink including a cationic polymerization component and is curable when irradiated with light, the printer comprising:

a recording head for ejecting the ink to the recording medium;

a light irradiation section for irradiating UV irradiation as the light to the ink placed on the recording medium;

a humidity detecting section for detecting humidity around the ink placed on the recording medium; and a controller for controlling irradiation of the light to be irradiated from the light irradiation section on the basis of detected humidity detected by the humidity detecting section, wherein the controller controls the irradiation of the light so as to be higher in case the detected humidity is not less than predetermined humidity, and controls the irradiation of the light so as to be lower in case the detected humidity is less than the predetermined humidity; and wherein the recording medium is a film made of non-absorptive plastic.

9. The printer of claim 8, wherein the film is capable of shrinking with heat.

10. The printer of claim 8, wherein the controller controls the irradiation of the light so as to be higher in case the detected humidity is 50% or higher.

* * * * *